US007071928B2

(12) United States Patent
Kwon et al.

(10) Patent No.: US 7,071,928 B2
(45) Date of Patent: Jul. 4, 2006

(54) LIQUID CRYSTAL DISPLAY DEVICE HAVING QUAD TYPE COLOR FILTERS

(75) Inventors: Keuk-Sang Kwon, Kyoungsangbuk-do (KR); Joon-Ha Park, Taegu (KR)

(73) Assignee: LG. Philips LCD Co., LTD, Seoul (KR)

( * ) Notice: Subject to any disclaimer, the term of this patent is extended or adjusted under 35 U.S.C. 154(b) by 460 days.

(21) Appl. No.: 09/750,162

(22) Filed: Dec. 29, 2000

(65) Prior Publication Data

US 2001/0017607 A1 Aug. 30, 2001

(30) Foreign Application Priority Data

Dec. 31, 1999 (KR) ..... 1999-67849

(51) Int. Cl.
*G09G 5/00* (2006.01)

(52) U.S. Cl. ..... 345/204; 345/98

(58) Field of Classification Search ..... 345/87, 345/88, 90, 92, 94, 96, 98, 99, 100, 204, 345/89

See application file for complete search history.

(56) References Cited

U.S. PATENT DOCUMENTS

| | | | | |
|---|---|---|---|---|
| 5,489,867 | A * | 2/1996 | Tamanoi | 327/269 |
| 5,856,818 | A * | 1/1999 | Oh et al. | 345/99 |
| 6,307,531 | B1 * | 10/2001 | Shin | 345/88 |
| 6,392,719 | B1 * | 5/2002 | Kim | 349/40 |
| 2001/0019382 | A1 * | 9/2001 | Song et al. | 349/106 |
| 2002/0075212 | A1 * | 6/2002 | Song | 345/87 |

FOREIGN PATENT DOCUMENTS

JP 04-168417 * 6/1992

* cited by examiner

*Primary Examiner*—Xiao Wu
*Assistant Examiner*—Jean Lesperance
(74) *Attorney, Agent, or Firm*—Birch, Stewart, Kolasch & Birch, LLP

(57) ABSTRACT

A quad type liquid crystal display device includes a liquid crystal panel having gate and data lines which define sub-pixel regions. Gate driving integrated circuits for driving the gate lines are provided. A plurality of data drive integrated circuits are arranged on one side of the liquid crystal panel. Each of the data drive integrated circuits have "m" (m is a natural number) number of channels, wherein (3n-1)th (n is a natural number) channels for each data drive integrated circuit are floating.

14 Claims, 5 Drawing Sheets

| | | | | | | | | |
|---|---|---|---|---|---|---|---|---|
| + | + | − | − | + | + | − | − | ⇨ Second Signal |
| + | + | − | − | + | + | − | − | ⇨ First Signal |

FIG.8A

| | | | | | | | | |
|---|---|---|---|---|---|---|---|---|
| − | − | + | + | − | − | + | + | ⇨ Second Signal |
| − | − | + | + | − | − | + | + | ⇨ First Signal |

FIG.8B

| | | | | | | | | |
|---|---|---|---|---|---|---|---|---|
| − | − | + | + | − | − | + | + | ⇨ Second Signal |
| + | + | − | − | + | + | − | − | ⇨ First Signal |

FIG.8C

LIQUID CRYSTAL DISPLAY DEVICE HAVING QUAD TYPE COLOR FILTERS

CROSS REFERENCE

This application claims the benefit of Korean Patent Application No. 1999-67849, filed on Dec. 31, 1999, under 35 U.S.C. § 119, the entirety of which is hereby incorporated by reference.

BACKGROUND OF THE INVENTION

1. Field of the Invention

The present invention relates to a liquid crystal display (LCD) device, and more particularly, to a LCD device having color filters arranged in quad type.

2. Description of Related Art

In general, the LCD device includes a liquid crystal panel having upper and lower substrates with a liquid crystal layer interposed. The upper substrate includes a common electrode and a color filter. The lower substrate is called an array substrate and includes gate lines arranged in a transverse direction and data lines arranged in a longitudinal direction perpendicular to the gate lines. A pixel electrode is formed on a region defined by the gate and data lines. Thin film transistors (TFTs) as a switching element are formed at a crossing point of the gate and data lines. Each of the TFTs includes a gate electrode, a source electrode and a data electrode. Peripheral portions of the two substrates are sealed by a sealant to prevent a liquid crystal leakage. The gate line serves to transmit scanning signals to the gate electrode, and the data line serves to transmit data signals to the source electrode.

In such an LCD device, a drive integrated circuit (IC) that applies signals to each electrode line on the lower substrate may be mounted using various methods, for example, a chip on board (COB), a chip on glass (COG), a tape carrier package (TCP), and the like.

FIG. 1 is a cross-sectional view illustrating a liquid crystal panel having a drive IC mounted thereon using the TCP technique. As shown in FIG. 1, a drive IC 17 is mounted on a polymer film 19, and the polymer film 19 having the drive IC 17 is connected with both a lower substrate 11 and a printed circuit board 15 through an anisotropic conductive film (AFC) 18. Signals are applied through such a tape carrier package from each end portion of gate and data lines (not shown) to drive the liquid crystal panel having the lower and upper substrates 11 and 13.

In a large-sized LCD device employing the TFT as a switching element, when a direct current bias is applied to the liquid crystal layer, the liquid crystal layer can be deteriorated. Thus, it is preferable to change a polarity of a voltage applied to the liquid crystal layer for each frame. Such an inversion driving method is classified into a frame inversion driving, a column inversion driving, a line inversion driving, and a dot inversion driving.

FIGS. 2A to 2D are plan views illustrating the four inversion methods described above. In the frame inversion driving method, as shown in FIG. 2A, all of the pixels receive signals of the same polarity in one frame and in next frame all of the pixels receive signals of inverse polarity. FIG. 2B illustrate the column inversion driving method, that pixels of every other column receive the signals of the same polarity and the polarity of the signal is changed at the next frame. FIG. 2C illustrate the line inversion driving method, that pixels of every other line (row direction) receive the signals of the same polarity and the polarity of the signal is changed at the next frame. FIG. 2D illustrate the dot inversion driving method. In the dot inversion drive method, the drive voltages applied to the pixel electrodes are such that the polarities of the adjacent two pixel electrodes, which are disposed adjacent to each other in either column or row direction, with respect to the counter electrode are opposite to each other. In other words, the polarities of the pixel electrodes with respect to the counter electrodes alternate as viewed along both the column direction and the row direction at each instance Through such inversion methods, a cross talk and a flickering of a screen can be reduced and a large-sized color LCD device is driven using such a method.

In order to drive the LCD device, gate drive ICs and data drive ICs, which are respectively connected with data lines and gate lines, are mounted to the liquid crystal panel through various method described above. Further, the LCD device employs either of a dual bank structure and a single bank structure to drive the liquid crystal layer. The dual bank structure is one that the data drive ICs are arranged on both upper and lower portion of the liquid crystal panel, and the single bank structure is one that the data ICs are arranged on either of the upper and lower portion of the liquid crystal panel.

FIG. 3 is a plan view illustrating a conventional quad type color LCD device. A liquid crystal panel 113 generally includes 1024×1024 number of dots, and a unit pixel includes four sub pixels or dots: a red (R), a green (G), a green (G), and a blue (B) as shown in FIG. 3. In order to drive the 1024×1024 number of dots, gate and data drive ICs have 1024 number of channels, respectively. The two gate drive ICs 113*a* are arranged on a left side portion of the liquid crystal panel 111, and two gate drive ICs 113*b* are arranged on a right side portion of the liquid crystal panel 111 in a dual bank method. Each of the gate drive ICs 113*a* and 113*b* has 256 channels. Also, the four data drive ICs 115*a* are arranged in an upper portion of the liquid crystal panel 111, and the four data drive ICs 115*b* are arranged in a lower portion of the liquid crystal display panel 111 in a dual bank method. Each of the data drive ICs 115*a* and 115*b* has 128 number of channels. The liquid crystal display panel 111 can employ the dot inversion driving method and the frame inversion driving method. An external controller can control such driving methods.

FIG. 4 is a plan view illustrating data signal transmissions of the liquid crystal panel having a dual bank structure according to a conventional art. As shown in FIG. 4, the data drive ICs 115*a* arranged in the upper portion of the liquid crystal panel 111 to drive odd data lines 121, and the data drive ICs 115*b* arranged in the lower portion of the liquid crystal panel to drive even data lines 123. Therefore, a difference of a signal delay due to a line resistance between the odd and even data lines may occur. For example, a difference of a signal delay between the adjacent two odd and even data lines may occur at portions A and A'. As a result, optical characteristics of the pixel may vary, whereby defects due to a brightness difference may occurs at the portions A and A'. In the liquid crystal panel described above, the gate and data drive ICs are arranged on side portions, and thus, the liquid crystal should be injected through a corner portion of the liquid crystal panel in a vacuum atmosphere using a dip method. However, the dip method may cause a contamination problem, and also a large amount of the liquid crystal is required.

In order to overcome the problems of difference of signal delay and the injection of the liquid crystal, a single bank data driving method has been introduced. The single bank data driving method is one that the data drive ICs are arranged on either of the upper and lower portions of the liquid crystal panel. FIG. 5 is a plan view illustrating a configuration of a liquid crystal panel having the single bank structure according to another conventional art. Three number of the data drive ICs 115 having 384 channels are arranged in the upper portion of the liquid crystal panel in order to drive 1024 number of the data lines. At this time, since the three data drive ICs have all 1152 number of channels, each of outmost data drive ICs 115*c* and 115*d* has 64 number of dummy channels. The dummy channels are from first channel to sixty fourth channel and a first effective channel is the sixty fifth channel. At this point, the data drive IC applies signals "+, −, +, − . . . " in series from the first channel, and next signal of series can be selected in the form of either "+, −, +, − . . . " or "−, +, −, + . . . " by an external controller. Thus, the inversion methods shown in FIGS. 2B and 2D can be established. But, the frame inversion for quad type color filters illustrated in FIG. 2A cannot be established. That is, it is impossible to inverse a whole pixel having four sub-pixels comprised of red, first green, second green, and blue, which lowers the application range of the liquid crystal panel.

SUMMARY OF THE INVENTION

To overcome the problems described above, preferred embodiments of the present invention provide a quad type liquid crystal display device in which a frame inversion driving and a dot inversion driving are all possible.

Another object of the present invention is to provide a quad type liquid crystal display device having a high brightness Another object of the present invention is to provide a quad type liquid crystal display device that can prevent waste of liquid crystal during interposing liquid crystal between the substrates.

In order to achieve the above object, the preferred embodiments of the present invention provide a quad type liquid crystal display device, comprising: a liquid crystal panel having gate and data lines which define sub-pixel regions; gate driving integrated circuits for driving the gate lines; and a plurality of data drive integrated circuits arranged on one side of the liquid crystal panel, each of the data drive integrated circuit having "m" (m is natural number) number of channels, wherein (3n-1)th (n is natural number) channels for each data drive integrated circuit are floating.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

For a more complete understanding of the present invention and the advantages thereof, reference is now made to the following descriptions taken in conjunction with the accompanying drawings, in which like reference numerals denote like parts, and in which:

FIGS. 8A to 8C respectively illustrate of a driving polarity state of a panel according to the embodiment of the invention.

DETAILED DESCRIPTION OF PREFFERED EMBODIMENTS

Reference will now be made in detail to preferred embodiments of the present invention, example of which is illustrated in the accompanying drawings.

Figure 1:
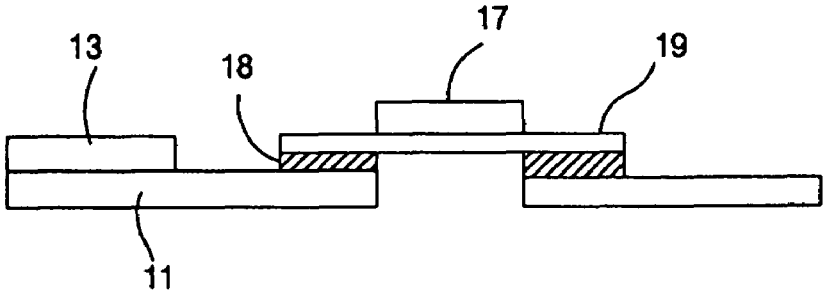
(RELATED ART) FIG.1
FIG. 1 is a cross-sectional view illustrating a typical liquid crystal panel mounting a drive IC using the TCP technique.
Figure 2A:
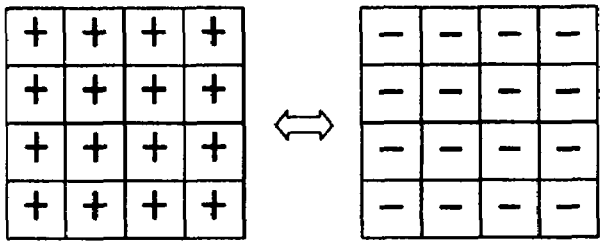
(RELATED ART) FIG.2A
FIGS. 2A to 2D are plan views illustrating, respectively, a frame inversion driving method, a column inversion driving method, a line inversion driving method, and a dot inversion driving method.
Figure 2B:
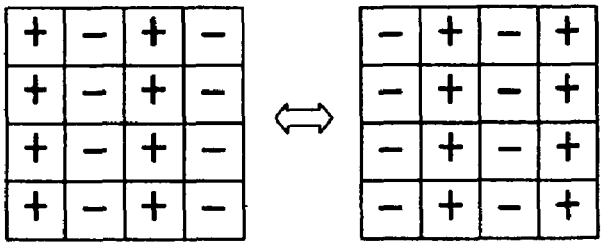
(RELATED ART) FIG.2B
Figure 2C:
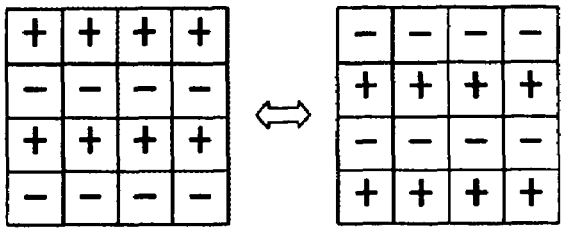
(RELATED ART) FIG.2C
Figure 2D:
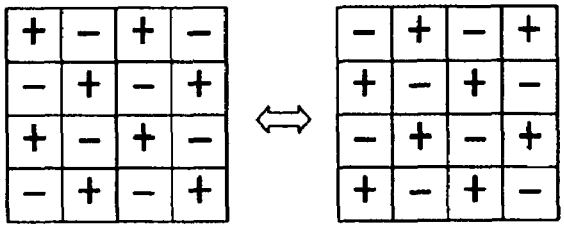
(RELATED ART) FIG.2D
Figure 3:
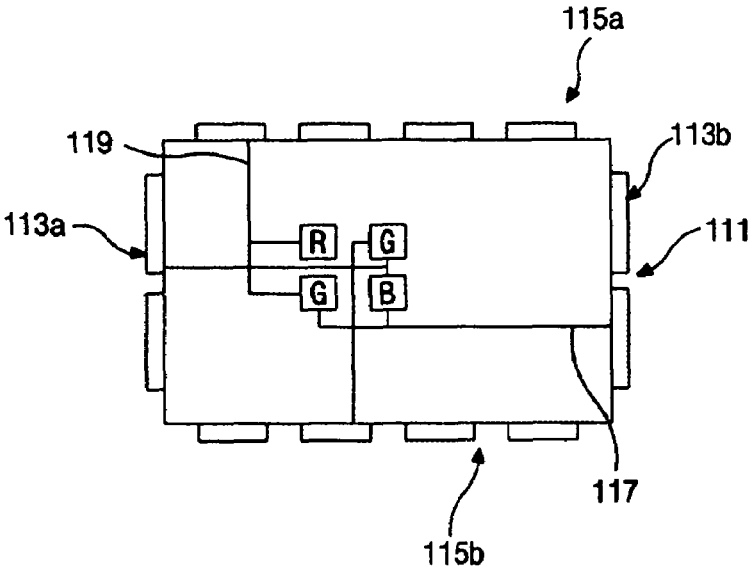
(RELATED ART) FIG.3
FIG. 3 is a plan view illustrating a quad type liquid crystal display device according to a conventional art.
Figure 4:
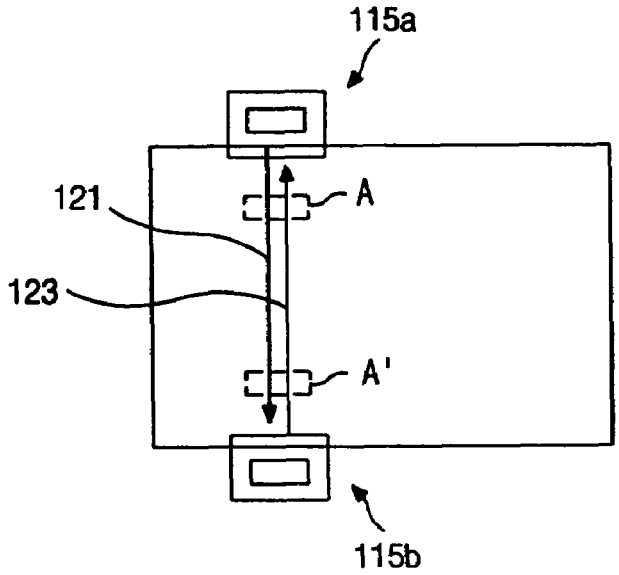
(RELATED ART) FIG.4
FIG. 4 is a plan view illustrating a configuration of a liquid crystal panel having a dual bank structure according to a conventional art.
Figure 5:
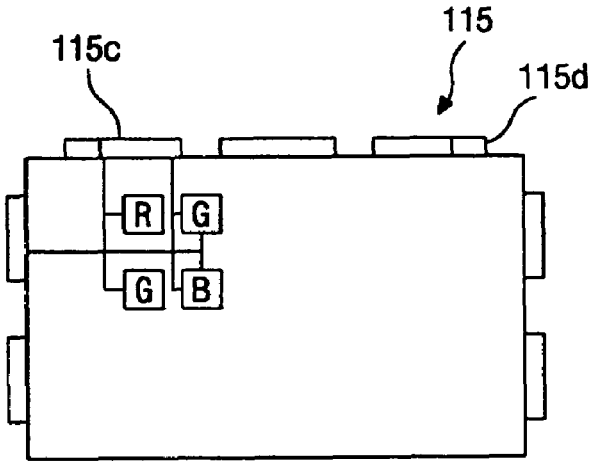
(RELATED ART) FIG.5
FIG. 5 is a plan view illustrating a configuration of a liquid crystal panel having a single bank structure according to a conventional art.
Figure 6:
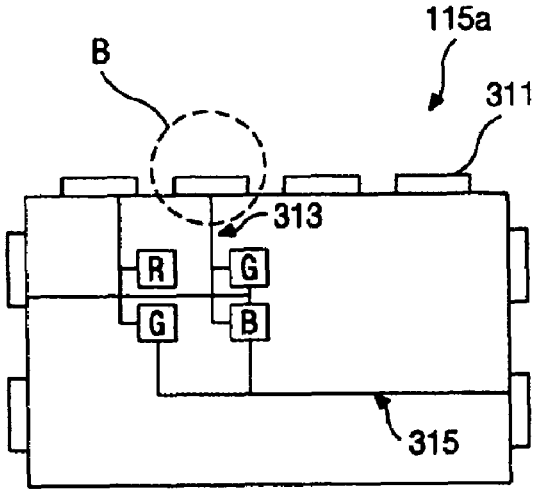
FIG. 6 is a plan view illustrating a configuration of a quad type liquid crystal display device having a single bank structure according to a preferred embodiment of the present invention.

FIG. 6 is a plan view illustrating a configuration of a quad type liquid crystal display device having a single bank structure according to a preferred embodiment of the present invention. As shown in FIG. 6, four data drive ICs 311 having 384 channels are arranged in the upper portion of a liquid crystal panel to drive 1024 number of channels. Two gate drive ICs are arranged in both right and left side portions of the liquid crystal panel, respectively. At this point, each data drive IC is designed to have lines for only 256 channels on a film (see 19 in FIG. 1) of a tape carrier package (TCP).

Figure 7:
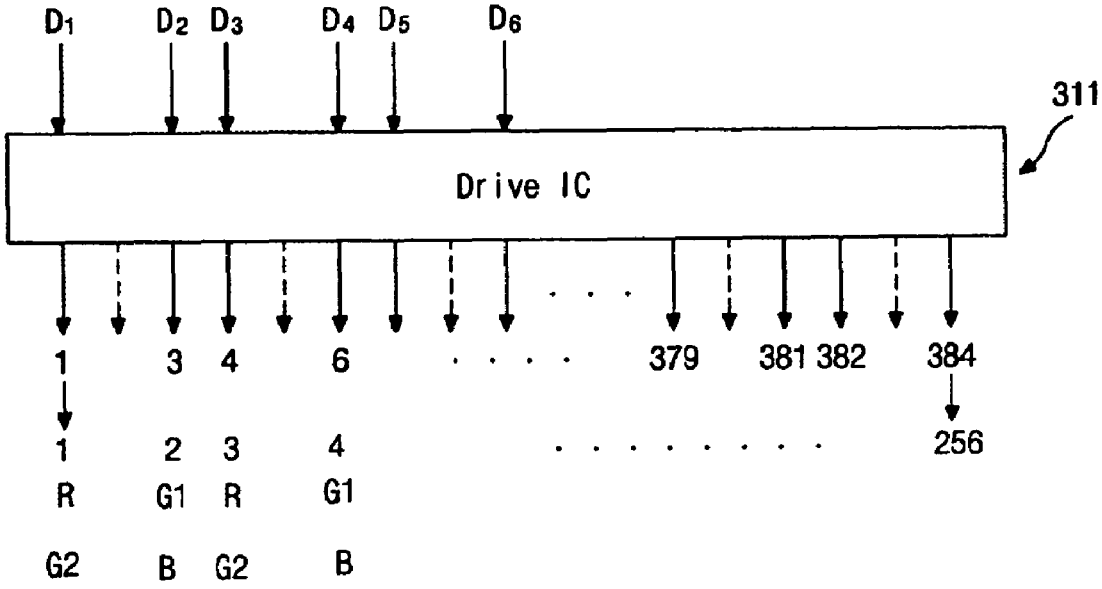
FIG. 7 is an enlarged view illustrating a portion "B" of FIG. 6.

FIG. 7 is an enlarged view illustrating a portion "B" of FIG. 6, illustrating an output state of the data drive IC according to the preferred embodiment of the present invention. As shown in FIG. 7, 128 channels of each data drive IC 311 become a floating state to output signals through 256 channels. Preferably, the channels that become a floating state are as follows: a 2nd channel, a 5th channel, an 8th channel, . . . , and a 383rd channel. In other words, the $2^{nd}$, $5^{th}$. . . (3n-1)th channels become a floating state.

The inversion process of the pixel region using the data drive IC having the above structure is explained with reference to FIGS. 8A to 8C. In the figures, only two lines are shown only for explanation. The two by two lines form a pixel having quad type color filters. As shown in FIG. 8A, first group of sub-pixels for a first pixel comprised of first two by two lines have positive polarity and next group of sub-pixels for a next pixel have negative polarity. This can be possible by applying same signal for a first and a second signals. That is, the Drive IC outputs "+−+−+−+−+−. . . " for first and second data signals. Then since the second, fifth, (3n-1)th signals are floating, the signals received by the pixels have the state of polarities as shown in FIG. 8A. The state of FIG. 8B is similar to that shown in FIG. 8A, and the only difference is starting polarity of the signal that is negative (−).

As shown in FIGS. 8A and 8B, the unit pixel having four sub-pixels can have same polarity and can be changed, thereby establishing a pixel inversion.

FIG. 8C illustrate a sub-pixel inversion method according to the embodiment of the invention, by changing the start polarity of first signal and second signal.

As described above, though adopting a single bank structure for the date drive IC, which has some advantages, the pixel inversion can be accomplished, thereby increasing application range of the liquid crystal display panel.

The advantages of the single bank structure are follows. The liquid crystal material can be injected through the side where no IC is located, result in an easy process and reduction of waste of liquid crystal material. Further, since the difference of the RC delay can be prevented, the display characteristic can be inhanced.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A quad type liquid crystal display device, comprising:

a liquid crystal panel having gate and data lines which define sub-pixel regions;

gate driving integrated circuits for driving the gate lines; and a plurality of data drive integrated circuits arranged on one side of the liquid crystal panel, each of the data drive integrated circuits having "m" (m is a natural number) number of channels, wherein $2^{nd}$, $5^{th}$, . . . (3n-1)th (n is a natural number) channels for each data drive integrated circuit are floating;

wherein pairs of pixels of the same polarity are separated by a floating state of an opposite polarity and adjacent pairs have opposite polarity.

2. The device of claim 1, wherein each of two by two sub pixels corresponds to red, a first green, a second green, and blue color filters, respectively.

3. The device of claim 1, wherein m is 384.

4. The device of claim 1, wherein the number of data integrated circuits is four.

5. The device of claim 1, wherein the data drive integrated circuits are located on only one side of the liquid crystal panel.

6. The device of claim 1, wherein there are at least three of said plurality of data drive integrated circuits.

7. A liquid crystal display panel;

a plurality of drive integrated circuits for driving the panel, each of said plurality of drive integrated circuits having "m" (m is a natural number) number of channels and "n" (n is a natural number) number of floating channels wherein $2^{nd}$, $5^{th}$, . . . (3n-1)th channels are floating and a plurality of films for connecting the drive integrated circuits, each film having (m-n) number of lines, wherein n<m; and wherein pairs of pixels of the same polarity are separated by a floating state of an opposite polarity and adjacent pairs have opposite polarity.

8. The liquid crystal display panel of claim 7, wherein m is 384.

9. The liquid crystal display panel of claim 7, wherein each of two by two sub pixels corresponds to red, a first green, a second green, and blue color filters, respectively.

10. The liquid crystal display panel of claim 7, wherein the number of drive integrated circuits is four.

11. The liquid crystal display panel of claim 7, wherein the drive integrated circuits are located on only one side of the liquid crystal panel.

12. The liquid crystal display panel of claim 7, wherein there are at least three of said plurality of drive integrated circuits.

13. A quad type liquid crystal display device, comprising:

a liquid crystal panel having gate and data lines which define sub-pixel regions;

gate driving integrated circuits for driving the gate lines; and a plurality of data drive integrated circuits arranged on one side of the liquid crystal panel, each of the data drive integrated circuits having "m" (m is a natural number) number of channels, wherein $2^{nd}$, $5^{th}$, . . . (3n-1)th (n is a natural number) channels for each data drive integrated circuit are floating, and wherein a first group of four sub-pixels for a first pixel have one of positive and negative polarity, and a next group of four sub-pixels for a next pixel have the other of positive and negative polarity, and remaining groups of four sub-pixels for remaining pixels alternate between positive and negative polarity.

14. A liquid crystal display panel;

a plurality of drive integrated circuits for driving the panel, each of said plurality of drive integrated circuits having "m" (m is a natural number) number of channels and "n" (n is a natural number) number of floating channels;

a plurality of films for connecting the drive integrated circuits, each film having (m-n) number of lines, wherein n<m, and wherein a first group of four sub-pixels for a first pixel have one of positive and negative polarity, and a next group of four sub-pixels for a next pixel have the other of positive and negative polarity, and remaining groups of four sub-pixels for remaining pixels alternate between positive and negative polarity.

* * * * *